United States Patent [19]

Scardenzan

[11] 4,135,259

[45] Jan. 23, 1979

[54] COVER ASSEMBLY FOR SWIMMING POOL

[76] Inventor: Anthony Scardenzan, 269 N. Hillcrest Blvd., Inglewood, Calif. 90301

[21] Appl. No.: 875,227

[22] Filed: Feb. 6, 1978

[51] Int. Cl.[2] ..... E04H 3/16; E04H 3/18

[52] U.S. Cl. ..... 4/172.11; 4/172.12; 4/172.13; 4/172.14; 4/172.19

[58] Field of Search ..... 4/172.11, 172, 172.12, 4/172.13, 172.14, 172.19

[56] References Cited

U.S. PATENT DOCUMENTS

| | | | |
|---|---|---|---|
| 2,912,703 | 11/1959 | Murphy | 4/172.11 |
| 2,970,320 | 2/1961 | Karp | 4/173.13 |
| 3,002,195 | 10/1961 | Prudek | 4/172.11 |
| 3,009,166 | 11/1961 | Sears | 4/172.11 |
| 3,051,964 | 9/1962 | Fisher et al. | 4/172.11 |
| 3,209,373 | 10/1965 | Meredith et al. | 4/172.11 |
| 3,777,319 | 12/1973 | Myles | 4/172.14 |
| 3,822,420 | 7/1974 | Kindness | 4/172.14 |
| 3,854,149 | 12/1974 | Mischke | 4/172.11 |
| 3,895,400 | 7/1975 | Kelcey | 4/172.11 |

*Primary Examiner*—Henry K. Artis
*Attorney, Agent, or Firm*—Keith D. Beecher

[57] ABSTRACT

A cover assembly for a swimming pool is provided which includes a rigid, sturdy deck member which fits over the top of the pool, and which also includes an hydraulic cylinder and linkage coupling the hydraulic cylinder to the deck member so that operation of the cylinder causes the deck member to be lifted clear of the top of the pool, while maintained in a horizontal position, and up to an elevated position, and at the same time shifting the deck member back to a position displaced from the side of the pool. When in its up or down position, the deck member may serve as a sun deck, for example, and when the deck member is in its upper position, it may also serve to provide shade adjacent to the pool.

7 Claims, 6 Drawing Figures

COVER ASSEMBLY FOR SWIMMING POOL

BACKGROUND OF THE INVENTION

Swimming pools have long presented a hazard to small children when not in use. In addition, and especially in back yards of limited size, swimming pools occupy a large proportion of the available space. Covers for swimming pools have been proposed in the past. However, such covers have never enjoyed any substantial commercial success, probably because they cannot be easily maneuvered to a closed and to an open position, and because they tend to become jammed, or otherwise inoperable. However, swimming pool covers have continued to be desirable, both from a safety factor, and also as a means for maintaining heat in the pool water during cool days and nights.

As far as is presently known, no pool covers have been proposed in the past which are readily movable from a position over the pool to a position displaced from the pool, and which are in the form of a rigid structure capable of supporting weight, and capable of serving as a deck when in either the closed or open positions.

The foregoing is a particular feature of the cover of the present invention. Moreover, an equally important feature is the fact that the cover can be moved quickly between its two positions merely by the operation of a simple control. Another important feature of the cover assembly of the invention is that the deck member cannot fall when raised to its upper position should power fail, so that the overall assembly is absolutely safe.

DETAILED DESCRIPTION OF THE ILLUSTRATED EMBODIMENT

Figure 2:
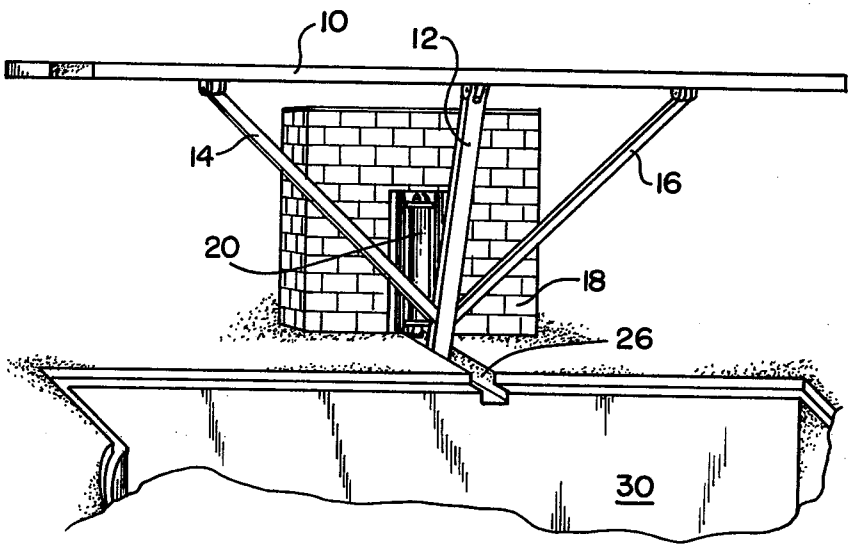
FIG. 2 is an elevational view of the assembly of the invention, with the deck member lifted up and away from the top of the pool.
Figure 1:
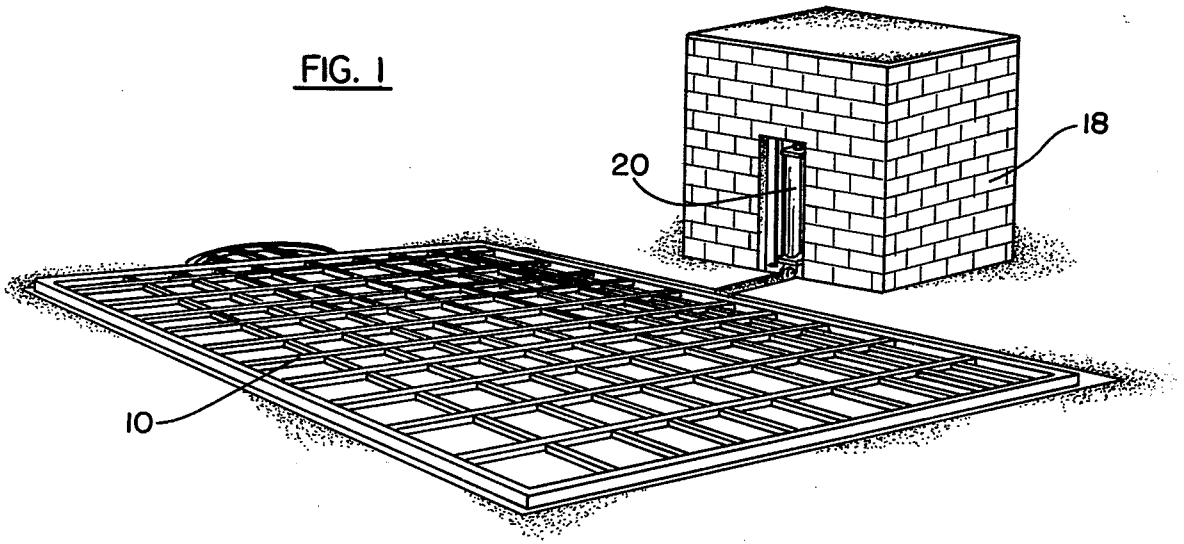
FIG. 1 is a perspective view of the cover assembly of the present invention with the deck member in place over the top of a swimming pool.

As shown in FIG. 1, the deck member 10 may be formed as a lattice-work of iron or steel tubing. The tubing, for example, may be two inch by two inch square tubing, which are welded together into the configuration shown in FIG. 1. A plywood deck formed, for example, of one-half inch marine plywood (not shown) may be fitted over the frame to complete the deck. As shown in FIG. 2, the deck member 10 is supported by a central main beam 12, and two additional beams 14 and 16. The beams 14 and 16 may be welded, or otherwise affixed to an intermediate point on the main beam 12, and the beams 14 and 16 diverge outwardly from the main beam to constitute support gussets for the deck 10. The beams 12, 14 and 16 are all pivotally coupled at their outer ends to the underside of the deck member 10.

Figure 4:
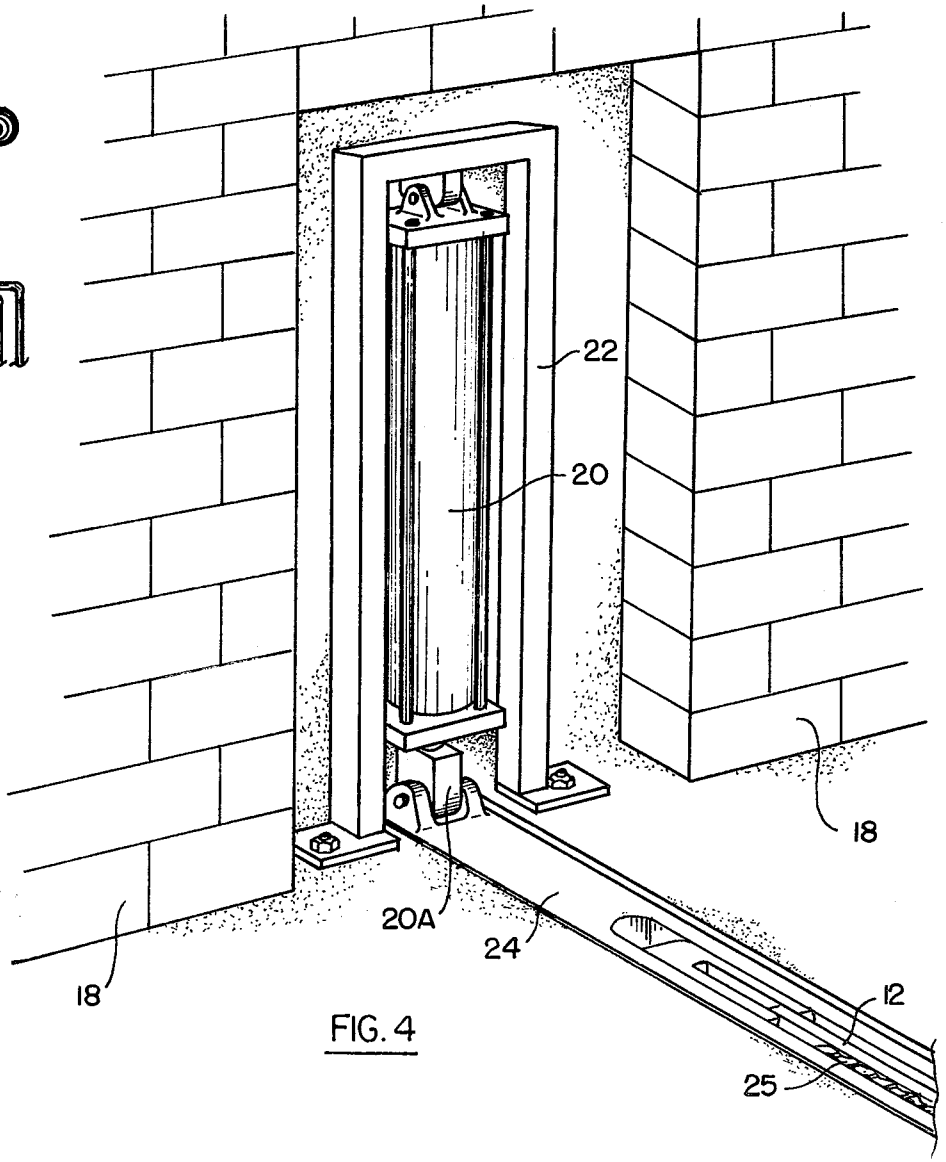
FIG. 4 shows the manner in which the hydraulic cylinder is mounted in an opening in a structure positioned to one side of the pool, and also shows a linkage arm which is coupled to the hydraulic cylinder, and which is also coupled to a main beam in the cover assembly to be described.

An appropriate housing 18 is located to one side of the pool, and an hydraulic cylinder 20 is mounted in an upright position in an opening in the front of the housing 18 on a stationary bracket 22. As best shown in FIG. 4, the arm 20A of the hydraulic cylinder 20 is pivotally coupled to an intermediate point on a linkage member 24, and one end of the linkage member is pivotally coupled to the other end of the main beam 12. A sprocket 25 is rotatably mounted on the pivot axis between the linkage arm 24 and beam 12.

Figure 3:
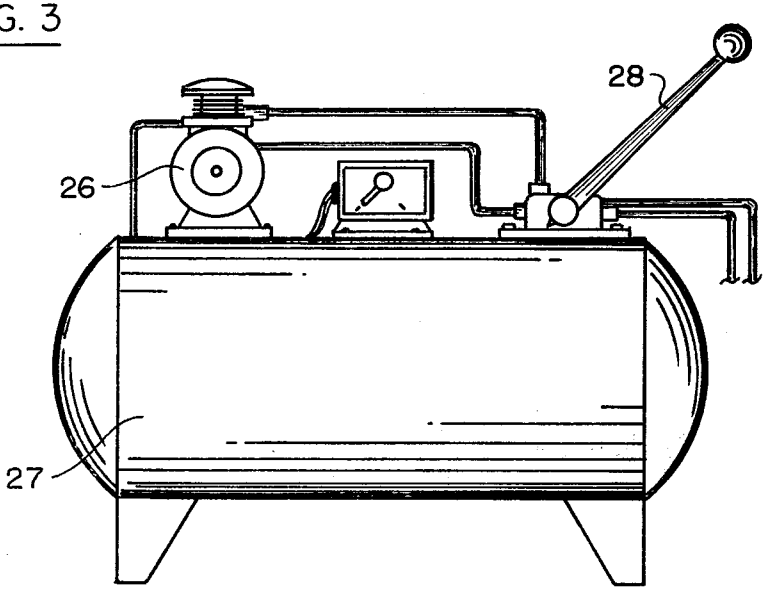
FIG. 3 is a view of an oil pump, and typical operating controls for an hydraulic cylinder which is used as a drive means in the embodiment of the invention to be described.

As shown in FIG. 3, an hydraulic oil pump 27 is provided within the housing 18, the pump being operated by an electric motor 26, and the hydraulic cylinder 20 being controlled by an operating lever 28 which causes the oil to be pumped into or released from hydraulic cylinder 20. When the operating lever 28 is placed in a first position, hydraulic oil is pumped into the hydraulic cylinder 20 causing the arm 22A of the hydraulic cylinder to move downwardly, which causes the linkage arm 24 to draw the beam 12 along a channel 25 formed in the decking on the side of the pool. This action causes the beam to turn upwardly to the position shown in FIG. 2, thereby lifting the cover deck 10 from the position shown in FIG. 1 to the position shown in FIG. 2. As the arm 22A of the hydraulic cylinder becomes fully extended, the deck 10 is moved back over the top of of the housing 18, and the main beam 22 assumes a vertical position. Then, when the lever 28 is moved to its initial position, the oil is released from cylinder 20, and the arm 22A returns to the position shown in FIG. 4. The pool cover is now returned to the position shown in FIG. 1, in which both the linkage arm 24 and beam 12 are disposed in horizontal axially aligned positions.

Figure 5:
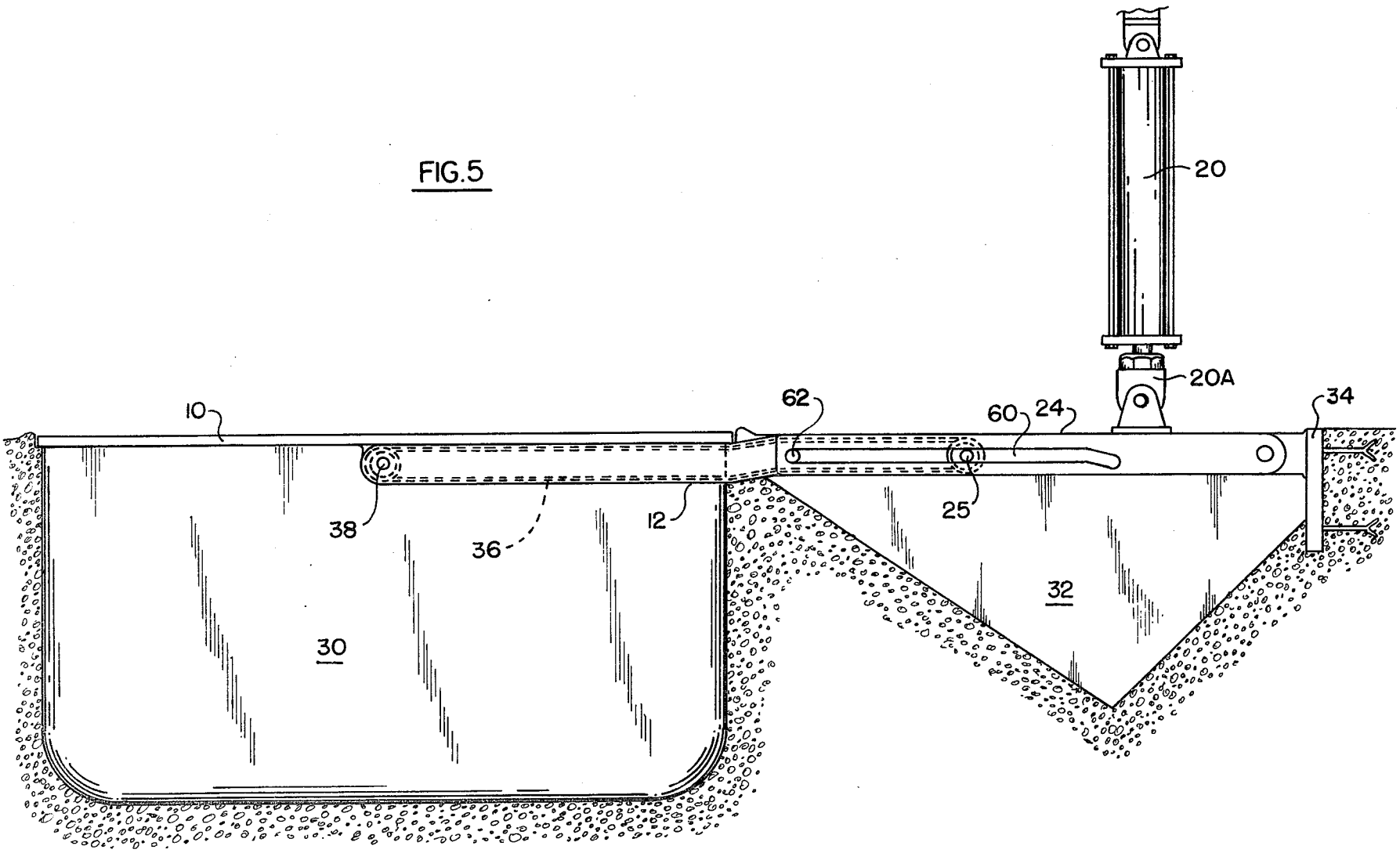
FIG. 5 is a side elevation of the overall assembly.

In the representation of FIG. 5, the swimming pool is shown in section, and is designated 30. A hole 32 is dug in the ground adjacent to the swimming pool to receive the linkage 24 and beam 12. As shown in FIG. 5, the other end of linkage 24 is pivotally coupled to a stationary bracket 34. As also shown in FIG. 5, a chain 36 is looped around sprocket 25, and around a further sprocket 38 which is rotatably mounted at the other end of beam 12. Sprocket 38 is attached to the deck 10, so that the deck turns with the turning of the sprocket 38.

As the hydraulic cylinder 20 is operated to lift the deck 10 from the position shown over the pool to its upper position, as shown in broken lines, the sprocket 25 turns, turning sprocket 38 by way of the chain 36, so as to maintain the deck member horizontal as it is swung up from its lower position to its upper position.

Figure 6:
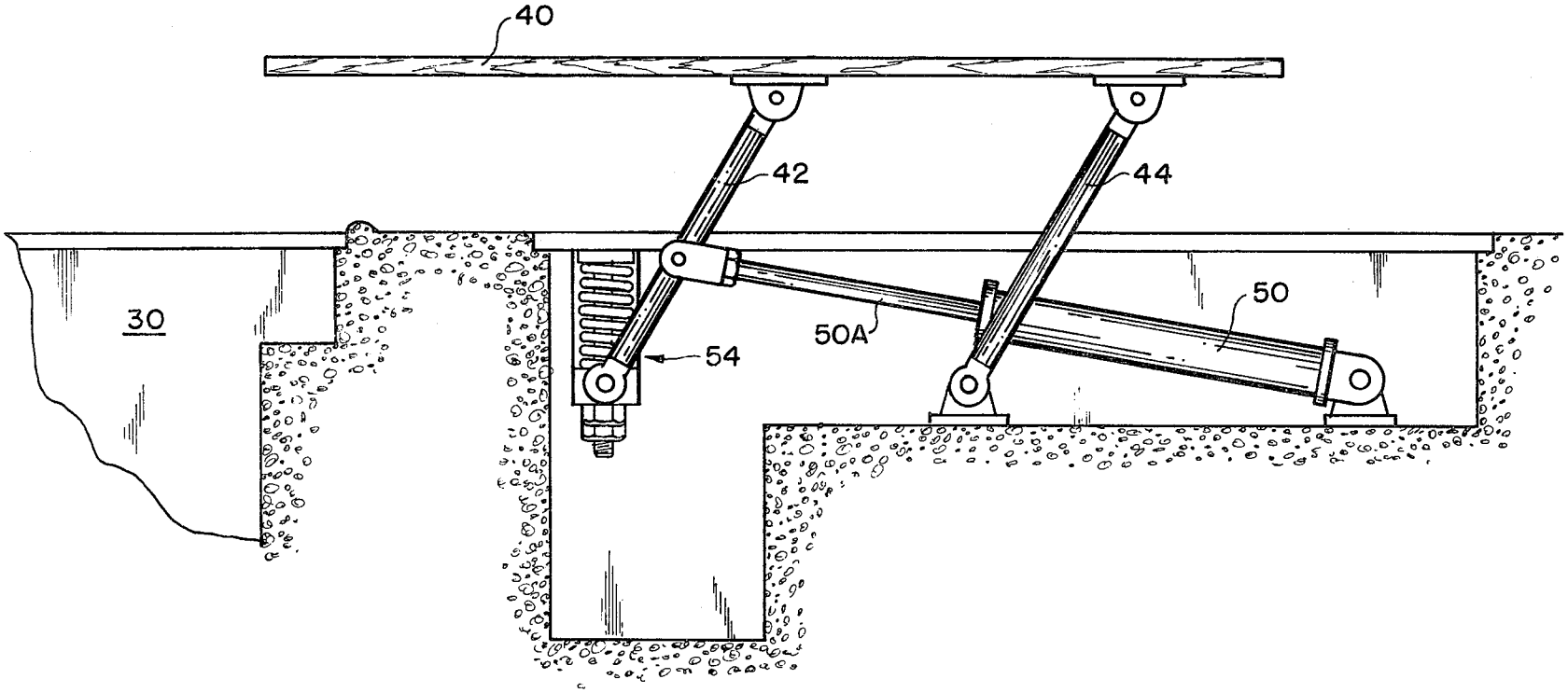
FIG. 6 is a side elevation of a retractable diving board which is mounted adjacent one end of the pool, and which is retracted before the deck member is lifted up from the top of the pool by the mechanism of the invention.

As shown in FIG. 6, a diving board 40 may be mounted at one end of the pool 30, the board being supported on a pair of linkage arms 42 and 44. A second hydraulic cylinder 50 is provided, whose arm 50A is pivotally coupled to the linkage arm 42. A spring unit 54 may be provided adjacent to the linkage arm 42. The hydraulic cylinder 50 is operated prior to the operation of the hydraulic cylinder 20, so that before the deck 10 is lifted up clear from the top of the pool, the arm 50A may be retracted, to retract the diving board 40 away from the pool, and out of the path of the deck 10. When the deck 10 is in its upper position, the hydraulic cylinder 50 is again operated to extend its arm 50A to the position shown in FIG. 6, so that the diving board 40 may be positioned to extend over the end of the pool. Then, before the deck 10 is again returned to its position over the top of the pool, the cylinder 50 is operated to retract the diving board so as to position the diving board clear of the path of the deck.

As shown in FIG. 5, a further member 60 is positioned in the channel 26 to form a guideway for a pin 62 which extends outwardly from beam 12. Pin 62 is moved from one end to the other of the guideway formed by member 60 as beam 12 is moved from its horizontal position to its vertical position. When the beam 12 is in its vertical position, the guide pin 62 is positioned to the right-hand end of the guide slot, which is inclined slightly downwardly, so as to provide a positive support for the beam, and for the deck 10 in its upper position, so that the deck 10 is firmly held in its upper position, and the support does not depend on hydraulic pressure, or the like.

The cover mechanism of the invention is extremely easy to operate, as mentioned above, and can be moved between its lower and upper positions in a matter of minutes. Also, the mechanism is rugged and safe, and includes a deck member which can be used in either its upper or lower positions as a sun deck, or the like.

If desired, and if local ordinances require it, the hydraulic cylinder 20 can be inverted and mounted below ground. In fact, if so desired, the entire mechanism within housing 18 may be mounted underground, eliminating the need for the housing and providing more deck space for the users.

It will be understood, of course, that the pool itself and associated cover may have any of a variety of shapes and sizes. The frame-work for the cover may be formed of aluminum, or other appropriate metal or material, in order to lighten the assembly.

It will be appreciated that while particular embodiments of the invention have been shown and described, modifications may be made. It is intended in the claims to cover the modifications which come within the spirit and scope of the invention.

What is claimed is:

1. A cover assembly for a swimming pool comprising: a rigid deck member configured to fit over the top of the pool; an elongated beam pivotally coupled at one end to an intermediate point on the underside of the rigid deck member; a linkage arm pivotally coupled at one end to the other end of said beam; means pivotally coupling the other end of the linkage arm to a stationary point causing the linkage arm to be in horizontal axial alignment with the beam and the beam to extend transversely across the underside of the deck member when the deck member is in position on top of the pool; and drive means coupled to the linkage arm to cause the linkage arm to swing angularly about said stationary point in a first direction to cause said beam to be displaced away from the underside of said rigid deck member and to swing from said horizontal position to a vertical position thereby lifting said deck member up and away from the top of the pool, and to cause said linkage arm to swing angularly about said stationary point in a second direction to cause said beam to swing from its vertical position to its horizontal position and to be displaced towards the underside of said rigid deck member thereby returning said deck member to the top of the pool.

2. The cover assembly defined in claim 1, in which said drive means comprises an hydraulic cylinder.

3. The cover assembly defined in claim 1, and which includes means for maintaining said deck member in a horizontal position as said beam is swung between its horizontal and vertical positions.

4. The cover assembly defined in claim 3, in which said last-named means comprises a pair of sprocket members rotatably mounted at the respective ends of the beam, and a chain member looped around the sprocket members, one of the sprocket members being connected to the deck member to cause the deck member to turn therewith.

5. The cover assembly defined in claim 1, and which includes two additional beams secured to an intermediate point on said first-named beam and diverging outwardly therefrom, the distal ends of the additional beams being pivotally coupled to the underside of the deck member at points displaced from the distal end of said first-named beam to serve as additional support means for the deck member.

6. The cover assembly defined in claim 1, and which includes a diving board mounted at one end of the pool, and means for retracting the diving board away from the edge of the pool prior to the deck member being lifted up and away from the top of the pool.

7. The cover assembly defined in claim 6, in which said last-named means comprises a second hydraulic cylinder, and linkage means coupling the second hydraulic cylinder to the diving board.

* * * * *